US007616082B2

(12) United States Patent
Katou

(10) Patent No.: US 7,616,082 B2
(45) Date of Patent: Nov. 10, 2009

(54) ELECTROMAGNETIC RELAY

(75) Inventor: Yoshimasa Katou, Watarai-gun (JP)

(73) Assignee: Matsushita Electric Works, Ltd., Kadoma (JP)

( * ) Notice: Subject to any disclaimer, the term of this patent is extended or adjusted under 35 U.S.C. 154(b) by 402 days.

(21) Appl. No.: 10/574,802

(22) PCT Filed: Jul. 11, 2005

(86) PCT No.: PCT/JP2005/012754

§ 371 (c)(1),
(2), (4) Date: Apr. 5, 2006

(87) PCT Pub. No.: WO2006/006557

PCT Pub. Date: Jan. 19, 2006

(65) Prior Publication Data

US 2008/0231397 A1 Sep. 25, 2008

(30) Foreign Application Priority Data

Jul. 14, 2004 (JP) ..... 2004-207688

(51) Int. Cl.
*H01H 51/22* (2006.01)

(52) U.S. Cl. ..... 335/83; 335/7; 335/20; 335/57; 335/151; 335/155; 335/196; 361/278; 361/299.2; 361/520; 361/536; 361/540

(58) Field of Classification Search ..... 335/7, 335/20, 57, 83, 151, 155, 196; 361/278, 361/299.2, 520, 536, 540
See application file for complete search history.

(56) References Cited

U.S. PATENT DOCUMENTS 5,515,019 A 5/1996 Schedele (Continued)

FOREIGN PATENT DOCUMENTS

DE 1789649 6/1959

(Continued)

OTHER PUBLICATIONS

European Search Report, Oct. 13, 2008, issued in 05758298.3-1231/1681699 PCT/JP2005/012754.

*Primary Examiner*—Lincoln Donovan
*Assistant Examiner*—Mohamad A Musleh
(74) *Attorney, Agent, or Firm*—Edwards Angell Palmer & Dodge LLP

(57) ABSTRACT

The electromagnetic relay of the present invention comprises a base (10), an electromagnet (20) disposed on the base, an armature (30) supported rotatably by the base, a movable spring (40) whose one end has a movable contact (41) and the opposite end is secured to the base, a fixed contact (51) disposed opposite to the movable contact, and a card (60). The card has a coupling part (61) to be coupled to the armature and an insertion hole (62) to which the one end of the movable spring is inserted, and it deforms the movable spring elastically in conjunction with a swing motion of the armature to selectively open or close a connection between the movable contact and the fixed contact. The movable spring has a U-shaped hook formed by bending the one end of the movable spring toward the opposite end side, and the hook can pass through the insertion hole while being pushed by an inner surface of the insertion hole and being deformed elastically, and an end of the hook is engaged with the card.

6 Claims, 8 Drawing Sheets

U.S. PATENT DOCUMENTS

| | | | | |
|---|---|---|---|---|
| 5,805,039 | A * | 9/1998 | Smith | 335/78 |
| 5,907,268 | A | 5/1999 | Mader | |
| 6,081,177 | A | 6/2000 | Fausch | |
| 6,606,018 | B2 * | 8/2003 | Takano et al. | 335/78 |
| 6,731,190 | B2 * | 5/2004 | Yamashita et al. | 335/78 |
| 6,750,744 | B2 * | 6/2004 | Misumi et al. | 335/78 |
| 6,940,375 | B2 * | 9/2005 | Sanada et al. | 335/86 |

FOREIGN PATENT DOCUMENTS

| | | |
|---|---|---|
| GB | 1271389 | 4/1972 |
| JP | 50-1416 | 1/1975 |
| JP | 52-45064 | 4/1977 |
| JP | 1-246739 | 10/1989 |
| JP | 7-506696 | 7/1995 |
| JP | 2554315 | 11/1997 |
| JP | 11-102631 | 4/1999 |
| JP | 11-339624 | 12/1999 |
| JP | 2000-285782 | 10/2000 |
| JP | 2002-181023 | 6/2002 |

* cited by examiner

ELECTROMAGNETIC RELAY

BACKGROUND OF THE INVENTION

1. Technical Field

The present invention relates to an electromagnetic relay.

2. Description of the Related Art

Japanese Non-examined Patent Publication No. 11-339624 discloses an electromagnetic relay which links a rotation of an armature with a rotation of a movable spring through a card and makes a movable contact, provided on the movable spring, come into contact with or separate from a fixed contact in conjunction with the rotation of the armature. In this electromagnetic relay, the card has an insertion hole, and the movable spring is coupled to the card with its tip inserted into the insertion hole.

However, in the electromagnetic relay, there was a fear that the card may accidentally drop from the movable spring.

Japanese Non-examined Patent Publication No. 11-102631 discloses an electromagnetic relay which has a hook formed by bending a tip of the movable spring at about 90 degrees at the tip of the movable spring and engages the hook to a periphery of the insertion hole to prevent the detachment of the card.

However, in the case where the hook was bent at 90 degrees, like the above electromagnetic relay, it was difficult to insert the hook into the insertion hole. Especially, in a case where a plurality of movable springs were aligned along a moving direction of the card, it was very difficult to insert each hook into each hole.

As shown in FIG. 15, in order to prevent the drop of the card, another electromagnetic relay has, at a tip of the movable spring 100, hooks 101 aligned in a direction perpendicular to the longitudinal direction of the movable spring and having an elastic deformability.

However, in the above case, there was a problem that it was difficult to insert the hooks into the insertion hole, because the edges of the hooks 101 got in touch with the insertion hole when the hooks 101 were inserted into the insertion hole, and the friction between the hooks 101 and the insertion hole was large.

SUMMARY OF THE INVENTION

In view of the above problem, the object of the present invention is to provide an electromagnetic relay which can prevent an accidental drop of the card and is easy to insert the movable spring into the insertion hole of the card.

The electromagnetic relay of the present invention comprises a base, an electromagnet disposed on the base, an armature supported rotatably by the base so as to swing in response to excitation/non-excitation of the electromagnet, a movable spring whose one end has a movable contact and the opposite end is secured to the base, a fixed contact disposed opposite to the movable contact to constitute a contact mechanism together with the movable contact, and a card. The card has a coupling part to be coupled to the armature and an insertion hole to which said one end of the movable spring is inserted, and it deforms the movable spring elastically in conjunction with a swing motion of the armature to selectively open or close the contact mechanism. The feature of the present invention resides in that the movable spring has a U-shaped hook formed by bending said one end of the movable spring toward the opposite end side, and said one end of the movable spring is configured to be able to pass through the insertion hole while being pushed by an inner surface of the insertion hole and being deformed elastically, and an end of the hook is engaged with the card.

In the electromagnetic relay of the present invention, because the hook of the movable spring is U-shaped and one end of the movable spring can pass the insertion hole while being elastically deformed, it is easy to insert the movable spring into the insertion hole. By forming the hook into a U-shape, it is possible to reduce the friction between the movable spring and the insertion hole, and it is possible to inset the movable spring even with small force. Because the end of the hook is engaged with the card, after the movable spring was inserted into the insertion hole, it is possible to prevent an accidental drop (detachment) of the card.

Preferably, the card has a recess in the inner surface of the insertion hole, and the recess runs along an axial direction of the insertion hole so that the one end of the movable spring pushed by the inner surface of the insertion hole and elastically deformed in passing the insertion hole can escape to the recess. Such a recess allows the movable spring to be easily elastically deformed, whereby it becomes possible to insert the movable spring into the card with smaller force.

More preferably, the movable spring has slits on both sides of the hook. Such slits allow the hook to be easily elastically deformed, whereby it becomes possible to insert the movable spring into the card more easily.

Preferably, the card has a step on the inner surface of the insertion hole, and the end of the hook is engaged with a surface of the step opposite to a side from which the one end of the movable spring is inserted. In this case, it is possible to lower the height of the electromagnetic relay, as compared with a case that the hook is engaged with a surface of the card opposite to a side from which the one end of the movable spring is inserted.

Furthermore, preferably, a surface of the step on the side from which the one end of the movable spring is inserted is inclined toward an inside of the insertion hole. In this case, it is possible to guide the movable spring into the insertion hole easily when the movable spring is inserted into the insertion hole.

Preferably, the movable spring has a shoulder part for supporting a surface of the card on a side from which the one end of the movable spring is inserted, and the shoulder part is formed into a U-shape by bending a part of the movable spring toward the opposite end side. In this case, it is possible to reduce the friction between the shoulder part and the card, and it is possible to prevent deterioration of the reliability of the contacts caused by adhesion of the abrasion powder generated by the friction between the shoulder part and the card to the movable and fixed contacts.

The number of the contact mechanisms is not limited to one, but the electromagnetic relay of the present invention may have two or more contact mechanisms. In this case, preferably, the card has a plurality of insertion holes to which the one end of each of the movable springs is inserted, and the insertion holes comprise a first insertion hole and a second insertion hole. The first insertion hole has a step on an inner surface thereof, and the hook of the movable spring inserted into the first insertion hole is engaged with a surface of the step opposite to a side from which the one end of the movable spring is inserted, and the second insertion hole has no step to which the hook of the movable spring is engaged, and the card is not restrained by the hook inserted into the second insertion hole. In a manufacturing process, after a relay was assembled and its operation is checked, the relay may be taken apart to adjust the distance between the movable contact and the fixed contact. If every hook of the movable springs is engaged with the card, it may take a lot of trouble to detach the card from the movable springs, whereby worker efficiency may be lowered. So, by forming the first and second insertion holes as the insertion hole, and engaging the hook inserted into the first insertion hole to the step in the first insertion hole but not engaging the hook inserted into the second insertion hole, it becomes easy to detach the card from the movable springs if necessary, while preventing the accidental drop of the card.

DETAILED DESCRIPTION OF EXEMPLARY EMBODIMENTS

Figure 1:
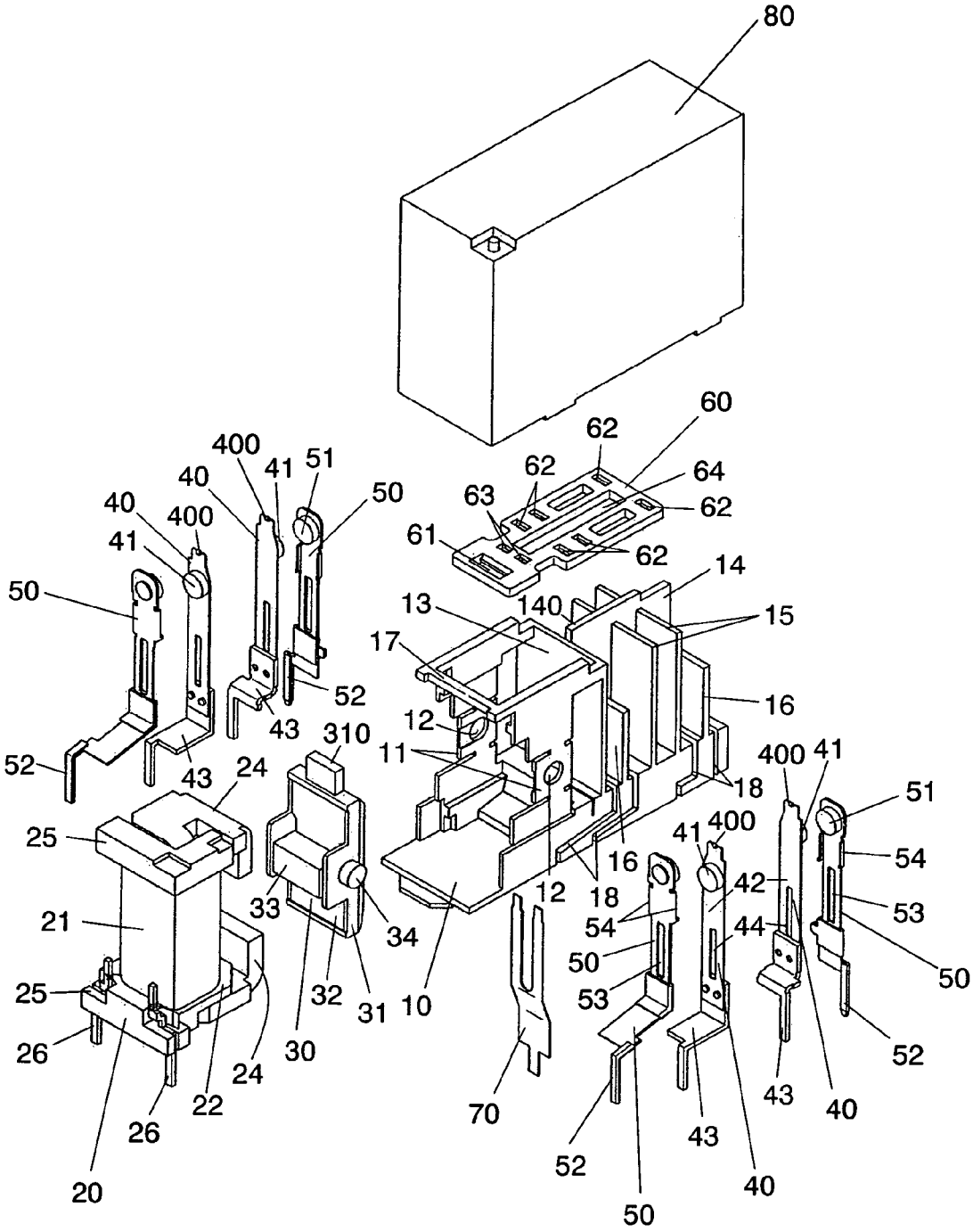
FIG. 1 is an exploded perspective view of an electromagnetic relay in accordance with an embodiment of the present invention.

Hereinafter, the present invention will be described in more detail with reference to the accompanying drawings. In the following explanation, upward and downward directions are related with reference to FIG. 3. FIG. 1 is an exploded perspective view of an electromagnetic relay in accordance with an embodiment of the present invention. This electromagnetic relay is a multipole electromagnetic relay having two normally open contacts and two normally closed contacts.

The electromagnetic relay comprises a base 10, an electromagnet 20, an armature 30, four movable springs 40 each having a movable contact 41 at its one end, four fixed springs 50 each having a fixed contact at its one end, a card 60, a return spring 70, and a cover 80.

The base 10 is a plastic molding and has a pair of side walls 11 and a plurality of insulating walls 13-16 molded in one piece. The base 10 is roughly divided into a first area where the electromagnet 20, the armature 30, and the return spring 70 are arranged and a second area where the movable spring 40 and the fixed spring 50 are arranged, by the insulating wall 13 formed along a direction perpendicular to a longitudinal direction of the base 10.

The pair of side walls 11 are formed in the first area, and each side wall 11 has a hole 12 for pivotally supporting the armature 30. Each side wall 11 is connected to the insulating wall 13 to increase mechanical strength, and each side wall 11 is connected to each other by a beam 17.

The insulating wall 14 is formed in the second area along a longitudinal direction of the base 10, and two insulating walls 15 are formed in the second area along a direction perpendicular to the longitudinal direction of the base 10. By the insulating wall 14 and the two insulating walls 15, four storage rooms for placing the movable springs 40 and the fixed springs 50 are formed at four corners of the second area. Each storage room is further divided into an area for placing the fixed spring 50 and an area for placing the movable spring 40 by the insulating wall 16 which is lower than the insulating walls 13-15.

In the side surface of the base 10 along the longitudinal direction of the base 10, a plurality of grooves 18 are formed to press the movable springs 40 and the fixed springs 50 into the base 10, and each groove 18 extends from the storage room to a bottom of the base 10.

Figure 2A:
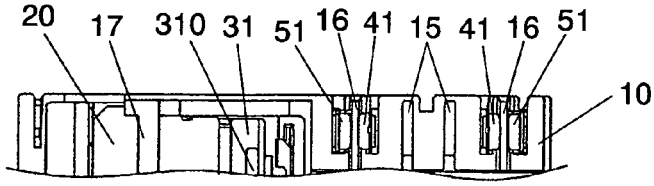
FIG. 2A is a plan view of a substantial part of the electromagnetic relay of FIG. 1 in which the cover and the card are detached.
Figure 2B:
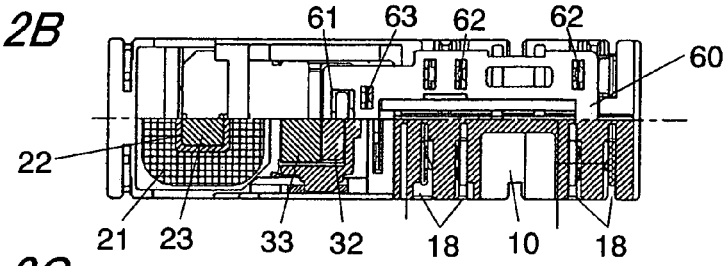
FIG. 2B is a fragmentary cross-sectional plan view of the electromagnetic relay of FIG. 1 in which the cover was detached.
Figure 2C:
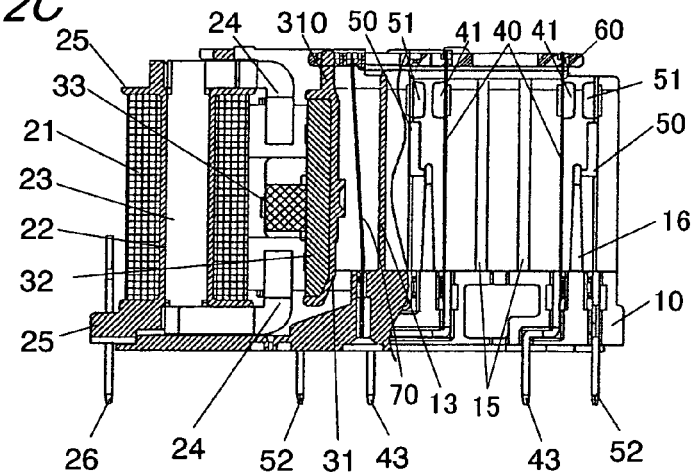
FIG. 2C is a fragmentary cross-sectional front view of the electromagnetic relay of FIG. 1 in which the cover was detached.
Figure 2D:
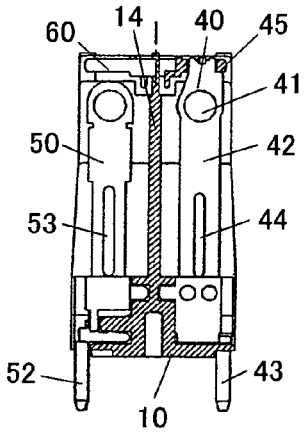
FIG. 2D is a cross-sectional side view of the electromagnetic relay of FIG. 1 in which the cover was detached.

The electromagnet 20 has a spool 22 onto which coil 21 was wound, a core 23 inserted into the spool 22 (see FIG. 2C), and yokes 24 which are generally L-shaped each and are connected to an upper and a lower end of the core 23. The spool 22 has flanges 25 at both ends, and coil terminals 26 connected to both ends of the coil 21 are pressed into the lower flange 25. The electromagnet 20 is fixed on the first area of the base 10, and the tips of the coil terminals 26 project downward from the bottom of the case 10.

The armature 30 comprises a sub-card 31 which is a plastic molding, a movable plate 32 made of soft iron and the like, and a permanent magnet 33 having a rectangular parallelepiped shape. The movable plate 32 is formed into a rectangular plate shape, and is bonded to the sub-card 31. The permanent magnet 33 is fixed on a surface of the movable plate 32. The sub-card 31 has a pair of cylindrical protrusions 34 on both side surfaces. The armature 30 is rotatably supported by the base 10 with the pair of cylindrical protrusions 34 fitted into the holes 12 formed in the side walls 11 of the base 10. When the armature 30 is attached to the base 10, an upper end of the movable plate 32 faces the upper yoke 24 of the electromagnet 20, and a lower end of the movable plate 32 faces the lower yoke 24 of the electromagnet 20.

The return spring 70 is generally Y-shaped, and a lower end thereof is pressed into the base 10 between the armature 30 and the insulating wall 13 (see FIG. 2C), and, as will be described later, an upper end thereof is inserted into a return-spring hole 63 of the card 60.

Each movable spring 40 comprises a thin metal plate 42 having elasticity and a terminal piece 43 formed by stamping and bending a metal plate. The movable contact 41 is fixed by caulking to the upper end of the metal plate 42. The metal plate 42 has a slit 44 so as to be bent easier. The terminal piece 43 is fixed by caulking to the lower end of the metal plate 42. The terminal piece 43 is pressed into the groove 18 from the side of the base 10, and as a result, the metal piece 42 is placed in the storage room of the base 10, and the tip of the terminal piece 43 projects downward from the bottom of the case 10.

Each fixed spring 50 is formed by stamping and bending a metal plate. The fixed contact 51 is fixed by caulking to the upper end of the fixed spring 50, and a terminal piece 52 is integrated with the lower end of the fixed spring 50. The fixed spring 50 also has a slit 53 so that the fixed spring 50 has certain degree of elasticity. In order to increase stiffness, the tip of the terminal piece 52 and a part of the terminal piece 52 to be pressed into the base 10 are formed by folding the metal plate doubly. The terminal piece 52 is pressed into the groove 18 from the side of the base 10, and as a result, the fixed spring 50 is disposed in the storage room of the base 10 and the tip of the terminal piece 52 projects downward from the bottom of the case 10.

Figure 3:
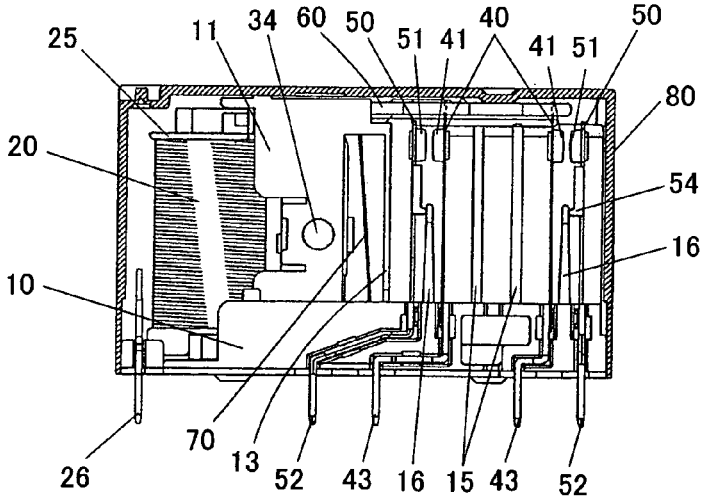
FIG. 3 is a cross-sectional front view of the electromagnetic relay of FIG. 1.

When the fixed spring 50 and the movable spring 40 are disposed on the base 10, the fixed contact 51 and the movable contact 41 face each other at predetermined intervals, as shown in FIG. 3, and constitute a contact mechanism. Each of the insulating walls 16 is located between each fixed spring 50 and each movable spring 40. The height of the insulating wall 16 is lower than the positions of the fixed contact 50 and the movable contact 41, so that the insulating wall 16 does not interfere with the motion of the movable contact 41 toward the fixed contact 51.

The card 60 is a plate-shaped plastic molding. The card 60 has a guide-groove 64 running along the longitudinal direction of the card 60. The card 60 is arranged above the base 10 with the guide-groove 64 engaged onto a guide-protrusion 140 formed at the top edge of the insulating wall 14 (see FIG. 1), and is slidable along the longitudinal direction of the base 10. The card 60 further has a coupling-hole 61 into which a protrusion 310 formed at the top edge of the sub-card 31 of the armature 30 is inserted, and a plurality of insertion holes 62 to which the upper ends of the movable springs 40 are inserted. When the protrusion 310 and the upper ends of the movable springs 40 are inserted into the coupling-hole 61 and the insertion holes 62, respectively, the armature 30 and the movable springs 40 are mechanically coupled to each other through the card 60, whereby the movable springs 40 rotate in conjunction with the rotation of the armature 30 to selectively open or close the contact mechanism. The card 60 further has return-spring holes 63 into which the upper ends of the return spring 70 are inserted. When the upper ends of the return spring 70 are inserted into the return-spring holes 63, the card 60 is given force toward the electromagnet 20 by the return spring 70.

Hereinafter, a mechanism for coupling the movable springs 40 to the card 60 will be described in more detail.

Figure 4A:
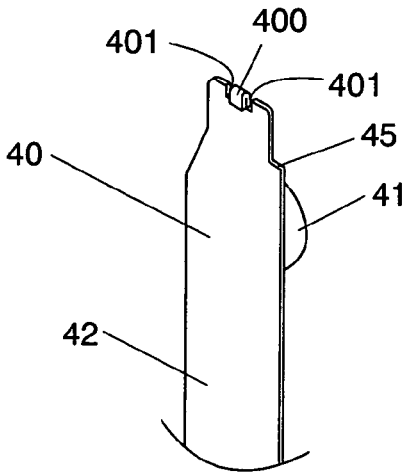
FIG. 4A is a partly enlarged perspective view of a movable spring of the electromagnetic relay of FIG. 1.
Figure 4B:
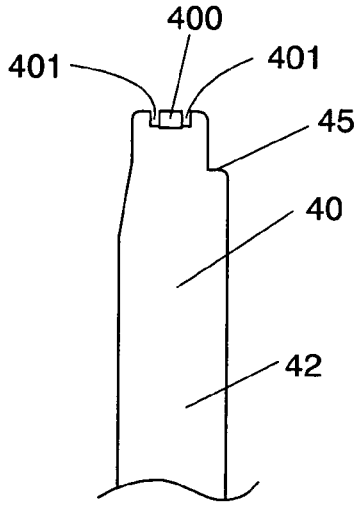
FIG. 4B is a partly enlarged view of a movable spring of the electromagnetic relay of FIG. 1.

As shown in FIGS. 4A and 4B, each movable spring 40 has a hook 400 at one end (the upper end) thereof. The hook 400 is formed into a U-shape by extending a central part of the one end of the movable spring 40 and then bending it toward the opposite end (the lower end). In this embodiment, every hook 40 is bent so that it projects toward the left side of FIG. 3. Each movable spring 40 has slits 401 on both sides of the hook 400. Each movable spring 40 also has a shoulder part 45 for supporting a surface of the card 60 on a side from which the one end of the movable spring 40 is inserted (that is, for supporting the undersurface of the card 60).

Figure 5A:
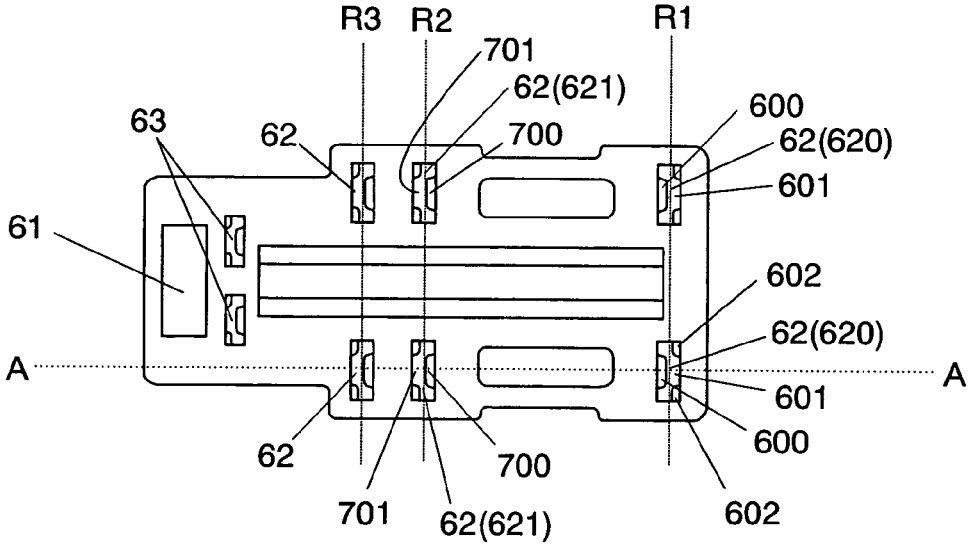
FIG. 5A is a plan view of a card of the electromagnetic relay of FIG. 1.

On the other hand, as to the card 60, as shown in FIG. 5A, the insertion holes 62 are arranged in three rows (R1-R3) along a direction perpendicular to the longitudinal direction of the card 60. In this embodiment, the insertion holes 62 comprise first insertion holes 620 and second insertion holes 621. The insertion holes arranged in a row (R1) on the right side of FIG. 5A are the first insertion holes 620, and the insertion holes arranged in a middle row (R2) are the second insertion holes 621. The insertion holes arranged in a row (R3) on the left side of FIG. 5A are not used in the electromagnetic relay of this embodiment, but are used when the contact configuration is changed, as will be described later.

Figure 5B:
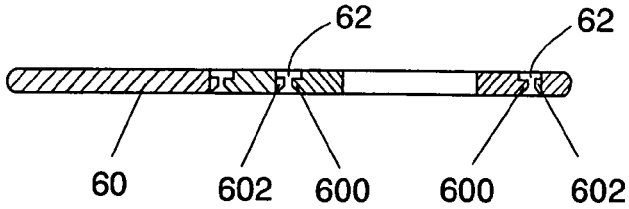
FIG. 5B is a cross-sectional view along a broken line A-A of the card of FIG. 5A.

Each of the first insertion holes 620 has a step 600 on the left side (in FIG. 5A) of the inner surface thereof. As shown in FIG. 5B, a surface of the step 600 opposite to a side from which the one end of the movable spring 40 is inserted, namely an upper surface of the step 600, is level, and a surface of the step 600 on a side from which the one end of the movable spring 40 is inserted, namely an undersurface of the step 600, is inclined toward the inside of the insertion hole 62. The first insertion hole 620 also has a recess 601 opposite to the step 600. The recess 601 is formed by forming protrusions 602 on both sides of the position of the recess 601. A distance between the step 600 and the protrusions 602 is set longer than a thickness of the thin metal plate 42 of the movable spring 40 and is set smaller than a thickness of the hook 400.

Figure 6A:
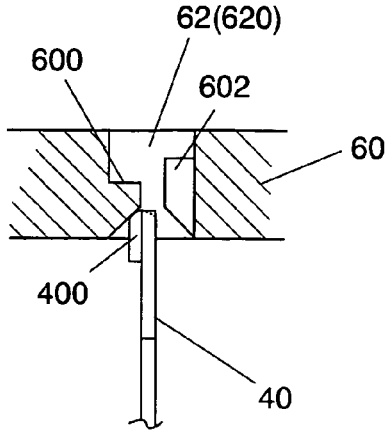
FIG. 6A is an enlarged view showing a substantial part of the electromagnetic relay of FIG. 1 when the movable spring is passing through a first insertion hole.
Figure 6B:
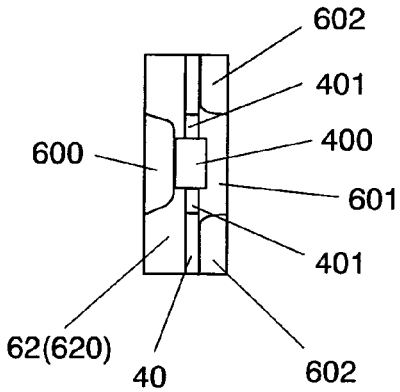
FIG. 6B is an enlarged view showing a substantial part of the electromagnetic relay of FIG. 1 when the movable spring is passing through the first insertion hole.
Figure 6C:
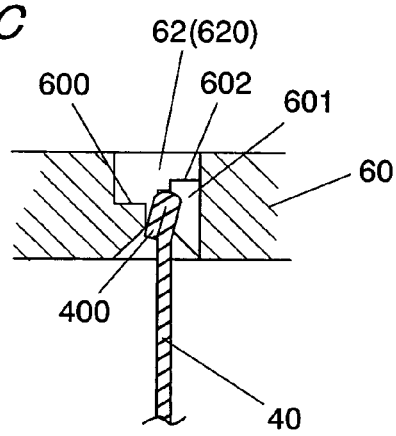
FIG. 6C is an enlarged view showing a substantial part of the electromagnetic relay of FIG. 1 when the movable spring is passing through the first insertion hole.
Figure 6D:
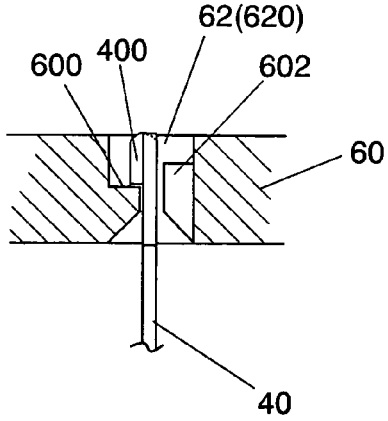
FIG. 6D is an enlarged view showing a substantial part of the electromagnetic relay of FIG. 1 after the movable spring passed the first insertion hole.
Figure 6E:
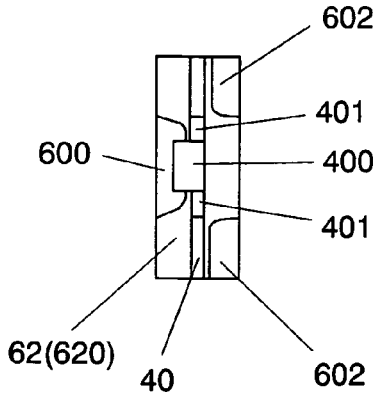
FIG. 6E is an enlarged view showing a substantial part of the electromagnetic relay of FIG. 1 after the movable spring passed the first insertion hole.
Figure 7:
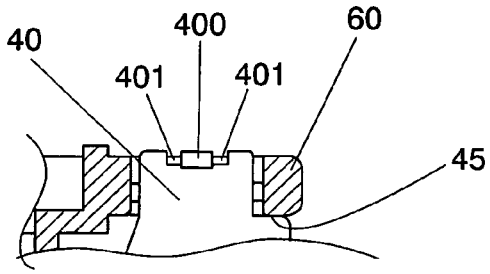
FIG. 7 is a view for explaining a positional relation between the card and the movable spring in the electromagnetic relay of FIG. 1.

Because the hook 400 of the movable spring 40 projects toward the left side of FIG. 3, namely the left side of FIG. 5A, and the step 600 projects toward the right side of FIG. 5A, as mentioned above, when the movable spring 40 is inserted into the first insertion hole 620, the top edge of the hook 400 comes in contact with the undersurface of the step 600, as shown in FIG. 6A. As shown in FIGS. 6B and 6C, when the movable spring 40 is further inserted into the first insertion hole 620, the top edge of the hook 400 gets in the clearance between the step 600 and the protrusions 602, whereby the hook 400 is pushed by the step 600 and is elastically deformed, and then escapes to the recess 601. As shown in FIGS. 6D and 6E, when the movable spring 40 is further inserted, the hook 400 gets across the step 600, and the end of the hook 400 is engaged to the upper surface of the step 600. At that time, as shown in FIG. 7, the card 60 is supported on the shoulder part 45 of the movable spring 40.

As mentioned above, because the first insertion hole 620 has a step 600 to which the hook 400 is engaged, the card 60 is prevented from dropping by the hook 400 after the movable spring 40 was inserted into the first insertion hole 620.

Because the hook 400 of this embodiment is formed into the U-shape by bending the one end (the upper end) of the movable spring 40 toward the opposite end (the lower end), the top edge of the hook 400 becomes a curved surface. So, the friction between the movable spring 40 and the insertion hole 62 is small when the movable spring 40 is inserted into the insertion hole 62, whereby it is easy to insert the movable spring 40. Furthermore, because the undersurface of the step 600 is inclined toward the inside of the insertion hole 62, it is easy to guide the upper end of the movable spring 40 into the insertion hole 62. Furthermore, because the slits 401 are formed on both sides of the hook 400, the hook 400 can be easily elastically deformed, and still furthermore, because the elastically deformed hook 400 can escape to the recess 601, it is possible to insert the movable spring 40 into the insertion hole 62 easily even with small force. Moreover, because the hook 400 is engaged with the step 600 inside the insertion hole 62, it is possible to reduce the height of the electromagnetic relay.

Figure 8:
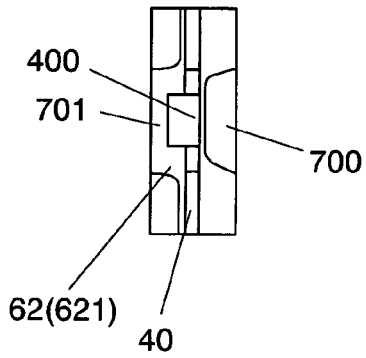
FIG. 8 is a view for explaining a movable spring inserted into a second insertion hole in the electromagnetic relay of FIG. 1.

On the other hand, the second insertion hole 621 has a step 700 on the right side (in FIG. 5A) of the inner surface thereof, and has a recess 701 opposite to the step 700. Because the hook 400 of the movable spring 40 projects toward the left side of FIG. 5A, the hook 400 is not engaged to the step 700, and the hook can move freely along the recess 701, as shown in FIG. 8. That is, the second insertion hole 621 does not have a step to which the hook of the movable spring 40 is engaged, and the card 60 is not restrained by the hook 400 inserted into the second insertion hole 621. The reason why the first and second insertion holes are provided as mentioned above will be explained below.

In an electromagnetic relay like this embodiment, in a manufacturing process, after the relay was assembled and the operation thereof is checked, the relay may be taken apart to adjust the distance between the movable contacts 41 and the fixed contacts 51. If every hook 400 of the movable springs is engaged with the steps 600, it may take a lot of trouble to detach the card 60 from the movable springs 40, whereby worker efficiency may be lowered. So, like this embodiment, by forming the first insertion hole in the row R1 and forming the second insertion hole in the row R2 and making the hook 400 engage with only the insertion holes in the row R1, it becomes possible to easily detach the card from the movable springs if necessary, while preventing an accidental drop (an inadvertent detachment) of the card.

After the card 60 was attached to the armature 30 and the movable spring 40, the cover 80 is attached to the base 10, and a sealant is injected into a gap between the base 10 and the cover 80, whereby the electromagnetic relay is completed.

Figure 9A:
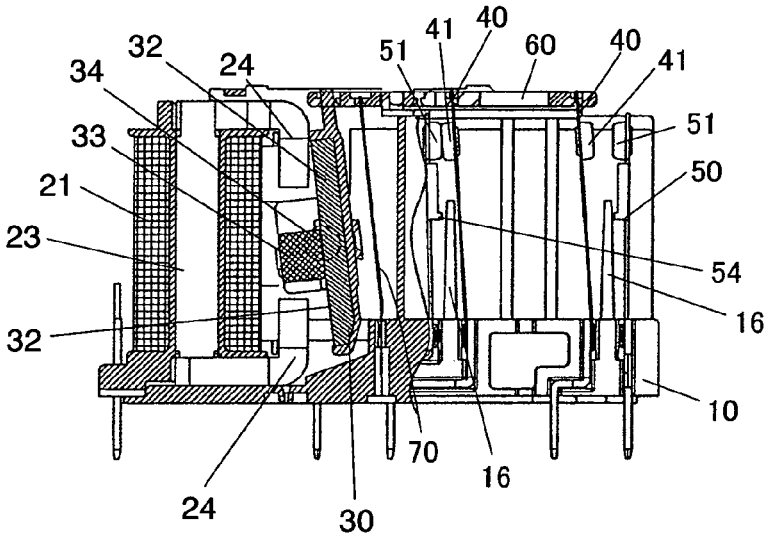
FIG. 9A is a view for explaining a motion of the electromagnetic relay of FIG. 1.

Hereinafter, the motion of the electromagnetic relay of this embodiment will be explained. As shown in FIG. 9A, when the electromagnet 20 is not energized, the movable plate 32 of the armature 30 is attracted to the upper yoke 24 by the magnetic force of the permanent magnet 33 and the spring force of the return spring 70. At that time, the movable contacts 41 in the row R2 are in contact with the corresponding fixed contacts 51, and the movable contacts 41 in the row R1 are away from the fixed contacts 51.

Figure 9B:
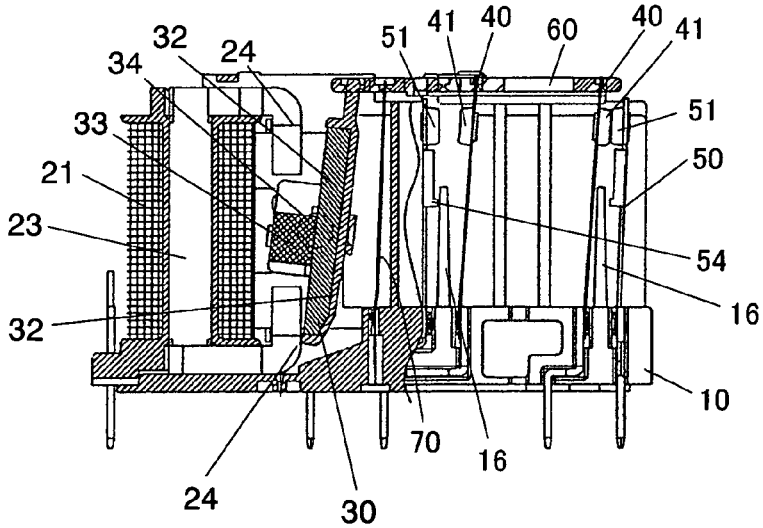
FIG. 9B is a view for explaining a motion of the electromagnetic relay of FIG. 1.

When the electromagnet 20 is energized, the movable plate 32 is attracted to the lower yoke 24, whereby the armature 30 rotates in a clockwise direction of FIG. 9A about the protrusions 34. As a result, as shown in FIG. 9B, the card 60 slides rightward of FIG. 9B along the longitudinal direction of the base 10, and the movable contacts 41 in the row R2 are separated from the fixed contacts 51 and the movable contacts 41 in the row R1 come in contact with the corresponding fixed contacts 51. When the movable contact 41 is separated from the fixed contact 51, restriction pieces 54 formed by bending part of the fixed spring 50 get in touch with the insulating wall 16, whereby the fixed spring 50 is restricted from moving toward the movable spring 40. So, even if the movable contact 41 is welded into the fixed contact 51, it is possible to pull away the movable contact 41 from the fixed contact 51 by the insulating wall 16.

When the energization of the electromagnet 20 is stopped, the armature 30 rotates in a counterclockwise direction of FIG. 9B by the spring force of the return spring 70 and the magnetic force of the permanent magnet 33, whereby the card 60 slides leftward to return to the state of FIG. 9A. As a result, the movable contacts 41 in the row R2 make contact with the corresponding fixed contacts 51 again, and the movable contacts 41 in the row R1 are separated from the fixed contacts 51. That is, the contact mechanisms in the row R2 are normally closed contacts, and the contact mechanisms in the row R1 are normally open contacts.

Figure 10:
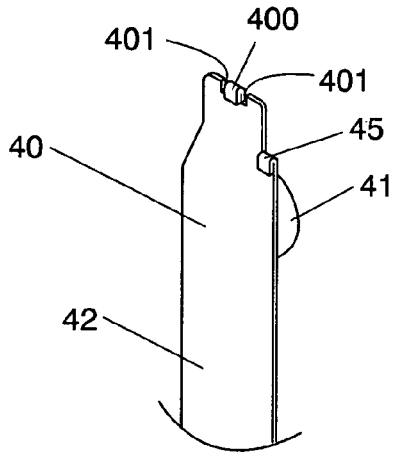
FIG. 10 is a modified form of the movable spring of the electromagnetic relay of FIG. 1.
Figure 11A:
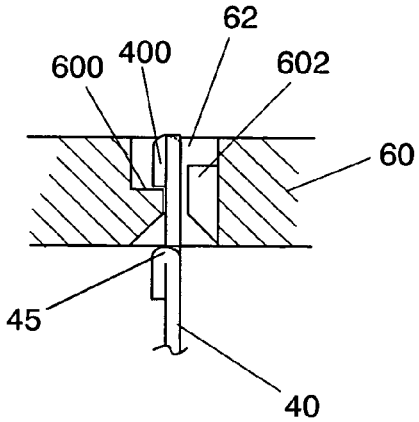
FIG. 11A is a view for explaining a positional relation between the card and the movable spring of FIG. 9.
Figure 11B:
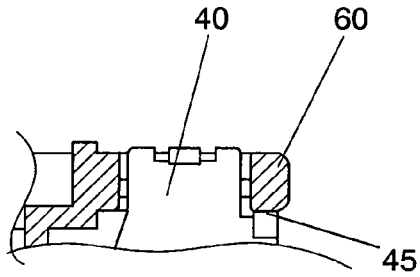
FIG. 11B is a view for explaining a positional relation between the card and the movable spring of FIG. 9.

As shown in FIGS. 10, 11A, and 11B, the shoulder part 45 of the movable spring 40 may be formed into a U-shape by bending a part of the movable spring 40 toward the opposite end thereof. When the card 60 moves on the shoulder part 45 repeatedly, the card 60 and the shoulder part 45 rub against each other, and abrasion powder may be generated. The abrasion powder may adhere to the movable contacts 41 and the fixed contacts 51, and may lower the reliability of the contacts. So, by forming the shoulder part 45 into a U-shape by bending a part of the movable spring 40 toward the opposite end thereof, it is possible to lower the friction and the wear between the shoulder part 45 and the card 60, and is possible to increase the reliability of the contacts.

Figure 12:
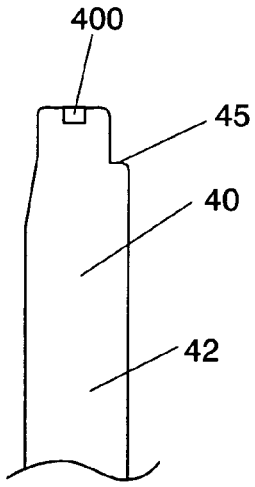
FIG. 12 is a view showing another modified form of the movable spring of the electromagnetic relay of FIG. 1.
Figure 13:
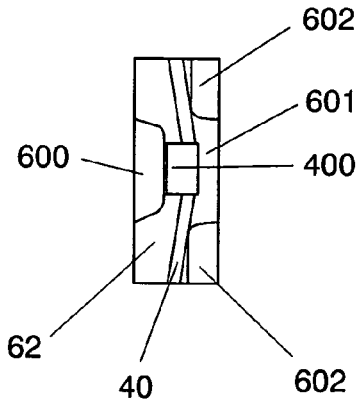
FIG. 13 is an enlarged view showing a substantial part when the movable spring of FIG. 12 is passing through the insertion hole.

The movable spring 40 may have no slits on both sides of the hook 400, as shown in FIG. 12. In this case, as shown in FIG. 13, when the hook 400 passes through the insertion hole 62, the whole top end of the movable spring 40 deforms elastically to escape to the recess 601, and passes the step 600.

In this embodiment, the first insertion holes 620 aligns in the row R1 and the second insertion holes 621 aligns in the row R2, the positions of the first and second insertion holes are not limited to this. The positions of the first and second insertion holes can be easily changed by just changing the projection direction of the hooks, although the hook 400 projects toward the left side of FIG. 3 in this embodiment.

In this embodiment, although the electromagnetic relay has two normally open contacts and two normally closed contacts, the electromagnetic relay can have four normally open contacts by counterchanging the positions of the movable springs 40 and the fixed contacts 50 in the row R2 and inserting the tips of the counterchanged movable springs into the insertion holes 62 in the row R3 to facing the movable contacts 41 and the fixed contacts 51 to each other. Or, the electromagnetic relay can have three normally open contact and one normally closed contact.

Figure 14:
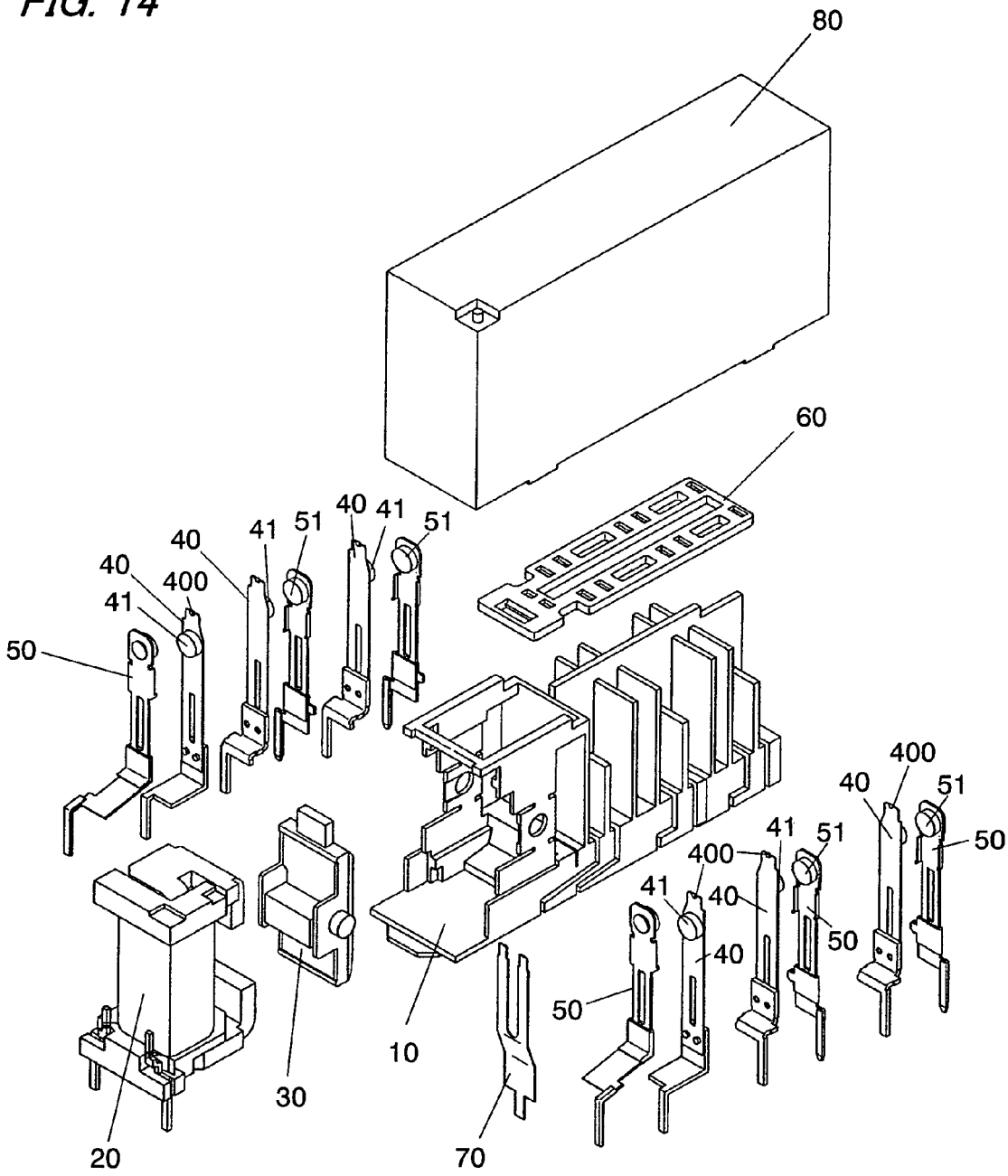
FIG. 14 is an exploded perspective view of an electromagnetic relay in accordance with another embodiment of the present invention.
Figure 15:
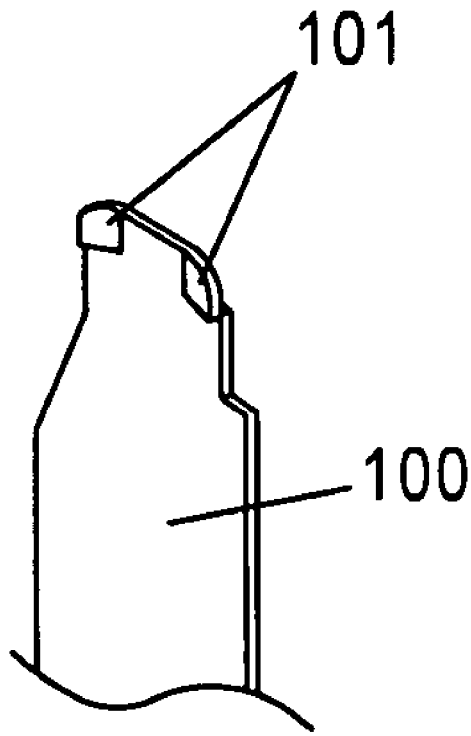
FIG. 15 PRIOR ART
FIG. 15 is a view showing one example of a conventional movable spring.

The electromagnetic relay of this invention is not limited to a relay having four pairs of the contact mechanisms, but may have, for example, six pairs of the contact mechanisms, as shown in FIG. 14.

As mentioned above, as many apparently widely different embodiments of this invention may be made without departing from the spirit and scope thereof, it is to be understood that the invention is not limited to the specific embodiments thereof except as defined in the appended claims.

The invention claimed is:

1. An electromagnetic relay comprising:

a base, an electromagnet disposed on said base, an armature supported rotatably by said base so as to swing in response to excitation/non-excitation of said electromagnet, a plurality of movable springs, one end of each of said movable springs having a movable contact and the opposite end of each of them being secured to said base, a plurality of fixed contacts, each of said fixed contacts being disposed opposite to each of said movable contacts to constitute a contact mechanism together with the corresponding movable contact, a card having a coupling part to be coupled to said armature and a plurality of insertion holes to which the one end of each of said movable springs is inserted, said card elastically deforming said movable springs in conjunction with a swing motion of said armature to selectively open or close the contact mechanisms, wherein each of said movable springs has a U-shaped hook formed by bending said one end of each of the movable springs toward the opposite end side, said one end of each of the movable springs being configured to be able to pass through said insertion hole while being pushed by an inner surface of said insertion hole and being deformed elastically, said insertion holes comprising a first insertion hole and a second insertion hole, said first insertion hole having a step on an inner surface thereof and said hook of said movable spring inserted into the first insertion hole being engaged with a surface of said step opposite to a side from which said one end of the movable spring is inserted, said second insertion hole having no step to which said hook of each of said movable springs is engaged and said card not being restrained by said hook inserted into said second insertion hole.

2. The electromagnetic relay as set forth in claim 1, wherein said card has a recess in the inner surface of said insertion hole, said recess running along an axial direction of said insertion hole so that said one end of the movable spring pushed by the inner surface of the insertion hole and elastically deformed in passing through the insertion hole can escape to said recess.

3. The electromagnetic relay as set forth in claim 2, wherein said movable spring has slits on both sides of said hook.

4. The electromagnetic relay as set forth in claim 1, wherein said card has a step on the inner surface of said insertion hole, said end of the hook being engaged with a surface of said step opposite to a side from which said one end of the movable spring is inserted.

5. The electromagnetic relay as set forth in claim 4, wherein a surface of said step on the side from which said one end of the movable spring is inserted is inclined toward an inside of said insertion hole.

6. The electromagnetic relay as set forth in claim 1, wherein said movable spring has a shoulder part for supporting a surface of said card on a side from which said one end of the movable spring is inserted, said shoulder part being formed into a U-shape by bending a part of said movable spring toward said the opposite end side.

* * * * *